US005459446A

United States Patent [19]

Vidal et al.

[11] Patent Number: 5,459,446

[45] Date of Patent: Oct. 17, 1995

[54] FLUID SPLASH BARRIER APPARATUS FOR AIRCRAFT CIRCUIT BREAKERS AND THE LIKE

[75] Inventors: Michael A. Vidal, Kingston; Roland G. Morin, Cumberland, both of R.I.

[73] Assignee: Texas Instruments Incorporated, Dallas, Tex.

[21] Appl. No.: 326,988

[22] Filed: Oct. 21, 1994

[51] Int. Cl.[6] ..... H01H 85/02; H01H 13/06; H01H 13/70; H01H 9/00

[52] U.S. Cl. ..... 337/188; 200/302.2; 200/345; 200/314; 200/DIG. 40

[58] Field of Search ..... 200/345, DIG. 40, 200/276.1, 302.2, 308, 314, 288; 337/188

[56] References Cited

U.S. PATENT DOCUMENTS

| | | | |
|---|---|---|---|
| 3,161,743 | 12/1964 | Roeser . | |
| 3,175,065 | 3/1965 | Strader | 200/314 |
| 3,316,379 | 4/1967 | Clark et al. | 200/168 |
| 3,668,356 | 6/1972 | Kekas | 200/345 |
| 3,678,424 | 7/1972 | Iwashima | 335/206 |
| 3,767,022 | 10/1973 | Olson | 400/481 |
| 4,277,665 | 7/1981 | Kondo | 200/314 |
| 4,400,677 | 8/1983 | Cobb, III et al. | 337/6 |
| 4,419,555 | 12/1983 | Kim | 200/314 |
| 4,874,913 | 10/1989 | Aoki | 200/314 |

FOREIGN PATENT DOCUMENTS

| | | | |
|---|---|---|---|
| 399568 | 3/1966 | Switzerland | 200/302.2 |

*Primary Examiner*—Leo P. Picard
*Assistant Examiner*—Stephen T. Ryan
*Attorney, Agent, or Firm*—Russell E. Bauman; Richard L. Donaldson; René E. Grossman

[57] ABSTRACT

A miniature aircraft type circuit breaker (10') has a threaded mounting bushing (18) in which a push button (20) is slidably received. Push button (20) is coupled to a movable contact arm (24) to move a movable electrical contact (26) into and out of engagement with a stationary electrical contact (28). A flexible fluid splash barrier sleeve (32) is telescopically received on a reduced diameter portion (34) of push button (20) above a white indicator portion (30) of the push button and has a lower distal end portion (36) which engages an annular top surface (38) of the bushing when push button (20) is depressed to bring the electrical contacts into engagement. Adhesive material may be used to affix the barrier sleeve to the reduced diameter portion (34) which optionally can have a roughened surface to enhance adhesion.

7 Claims, 2 Drawing Sheets

FLUID SPLASH BARRIER APPARATUS FOR AIRCRAFT CIRCUIT BREAKERS AND THE LIKE

FIELD OF THE INVENTION

This invention relates generally to circuit breakers and more particularly to fluid splash barriers for such circuit breakers.

BACKGROUND OF THE INVENTION

One of the primary uses of circuit breakers of the type with which the invention relates is to protect electrical loads and wires in aircraft. To be acceptable for this purpose, such circuit breakers need to be small in size, yet highly reliable. Such devices are manually actuatable, as well as being responsive to open circuits upon current overloads.

Circuit breakers of this type are shown and described, for example, in U.S. Pat, No. 4,400,677 assigned to the assignee of the present invention. The circuit breakers include, inter alia, a contact system in which a movable electrical contact is adapted to move into and out of engagement with a stationary electrical contact. A push button mounted on the circuit breaker housing is connected through a kinematic linkage mechanism to a movable contact arm mounting the movable electrical contact so that upon depression of the push button the movable contact arm is moved latching the movable electrical contact in engagement with the stationary electrical contact thereby closing the circuit. The circuit can be opened by pulling the push button upwardly with a selected amount of force to unlatch the mechanism with spring means causing separation of the electrical contacts. The circuit is also opened upon overcurrent conditions by means of a current carrying thermostat element which deflects causing unlatching of the mechanism and allowing the spring means to separate the electrical contacts and return the push button to its upper position.

The circuit breakers are generally mounted in a panel with the push button projecting through the panel into the cockpit area. In order to provide clear and prompt visual indication of the state of energization of the circuit breaker the push button has an annular white indicator portion which is exposed when the push button is in the upper or circuit open position, and which is covered by a bushing in which the push button is mounted when the push button is in the lower or circuit closed position.

Although circuit breakers of this type are very reliable and have a life expectancy of many thousands of cycles a problem exists in that splashed water, rain and other liquids can enter the interior of the circuit breaker through the interface between the push button and the mounting bushing in which the push button is slidably received. Such liquids can cause corrosion of the internal components thereby adversely affecting calibration of the circuit breaker and ultimately shortening the life expectancy of the device.

At least one attempt to solve this problem has included the provision of a flexible boot attached to a threaded nut which is threadably received on the mounting bushing with the boot covering the push button and sealing the interface. However, the boot makes it more difficult to grasp the push button in order to manually open the circuit breaker as well as impeding visibility of the indicator portion thereby interfering with visual inspection of the energization status of the circuit breaker. Even a relatively clear plastic boot tends to diffuse the available light and renders the indicator portion less prominent.

It is therefore an object of the invention to provide a circuit breaker having improved resistance to the entry of fluid into the interior of the circuit breaker housing. Another object is the provision of a fluid seal for use with a push button circuit breaker which does not adversely affect manual operation of the circuit breaker or of actuation and de-actuation forces and which does not interfere with visual indication of the status of energization of the circuit breaker.

SUMMARY OF THE INVENTION

Briefly, a push button operated circuit breaker made in accordance with the invention is provided with a splash barrier in the form of a flexible sleeve telescopically received on and attached to the push button. The push button is slidably mounted in a bushing between an upper, open circuit or de-energized position and a lower, closed circuit or energized position. The sleeve extends along the longitudinal axis of the push button from a lip formed at the outer end thereof generally to the beginning of the an annular white indicating portion on the push button so that upon depression of the push button to latch the movable contact arm of the circuit breaker in the contacts engaged position, the lower portion of the sleeve engages the top surface of the bushing and is placed in compression therewith to effectively form a fluid tight seal when the circuit breaker is in the closed circuit, energized position. The thickness of the sleeve is chosen so that it generally conforms to the outer diameter of the lip and effectively forms a smooth continuation of the button surface from the distal end to the annular indicator portion. Due to the flexible nature of the sleeve the button can be firmly grasped and force applied to the lip with the sleeve deforming radially inwardly to facilitate pulling out the push button to open the circuit breaker. In the open position with the push button in its upper position the annular white indicator portion is as fully visible as it is on circuit breakers having no splash barrier.

The invention accordingly comprises the construction hereinafter described, the scope of the invention being indicated in the appended claims.

BRIEF DESCRIPTION OF THE DRAWINGS

In the accompanying drawings in which the preferred embodiment is illustrated.

Corresponding reference characters indicate corresponding parts throughout the drawings.

DESCRIPTION OF THE PREFERRED EMBODIMENTS

Figure 1:
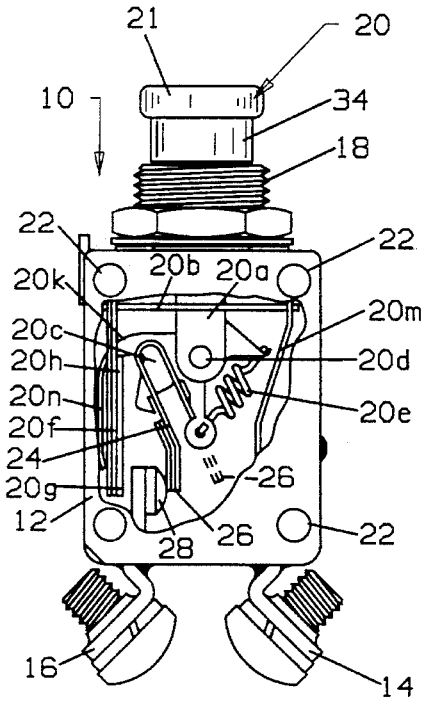
PRIOR ART FIG. 1
FIG. 1 is a front elevational view of a push button circuit breaker in the closed circuit position, the circuit breaker partially broken away to show the principle operating components including the stationary and movable electrical contacts.

Referring to the drawings, numeral 10 indicates generally a conventional miniature aircraft type circuit breaker comprising a housing 12 composed of rigid, electrically insulative material, line terminals 14, 16, threaded bushing 18 and push button 20. Housing 12 comprises first and second case halves held together by rivets 22.

Figure 2:
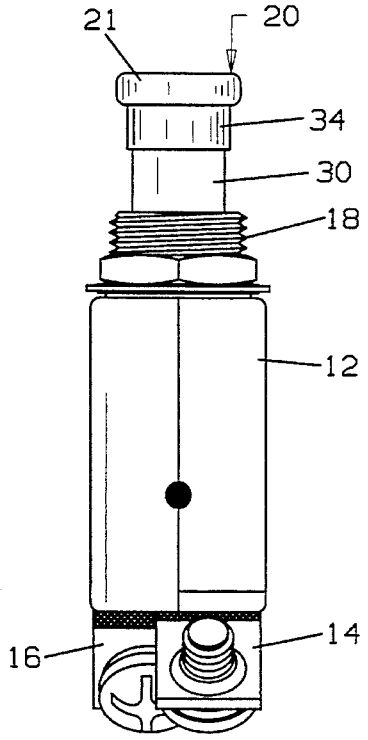
PRIOR ART FIG. 2
FIG. 2 is a side elevational view of the FIG. 1 circuit breaker but shown in the open circuit position.
Figure 3:
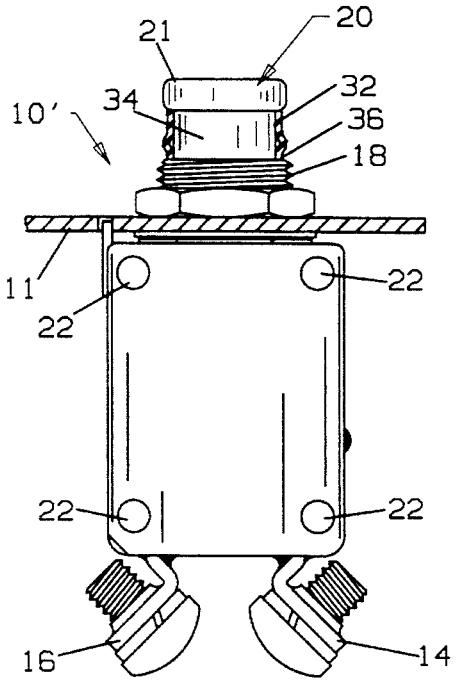
FIG. 3 is a view similar to FIG. 1 showing the circuit breaker mounted on a panel and with the fluid splash barrier disposed on the push button and in engagement with the circuit breaker mounting bushing.
Figure 4:
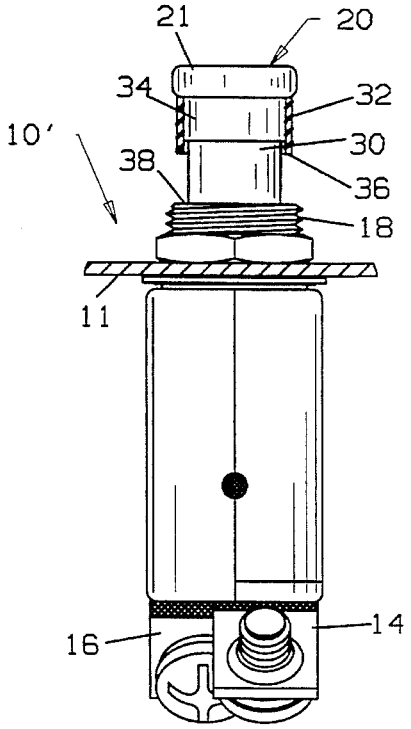
FIG. 4 is a side elevational view of the FIG. 3 circuit breaker but shown in the open circuit position.
Figure 5:
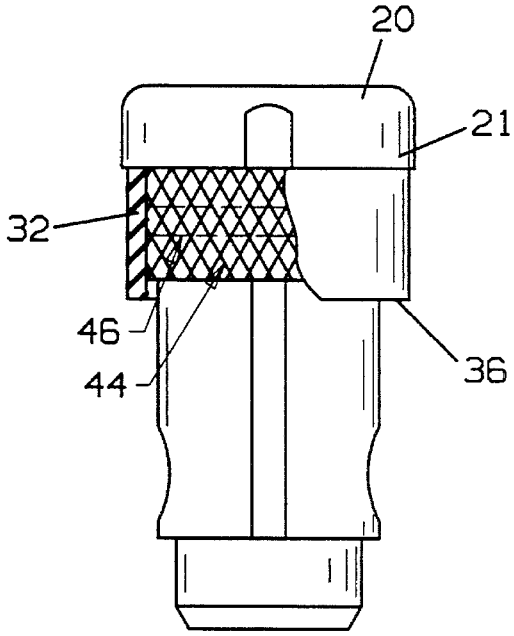
FIG. 5 is an enlarged elevational view of a circuit breaker push button shown with a fluid splash barrier partly broken away.
Figure 6:
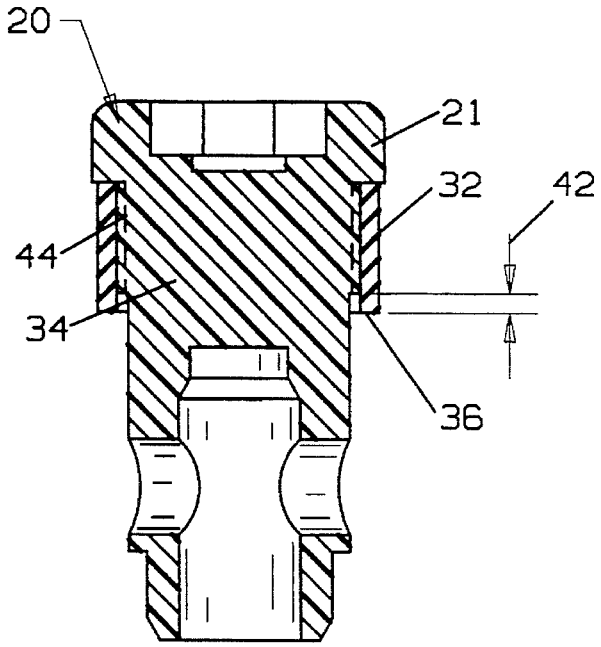
FIG. 6 is a cross sectional view of the FIG. 5 structure.

Push button 20 is slidably mounted in bushing 18 and has an attached operating portion 20*a* connected to a bell crank 20*c* through shaft 20*d*. A spring 20*e* biases the bell crank to rotate in a counterclockwise direction as viewed in FIG. 1 and a latch 20*f* pivotable in a slot 20*g* in housing 12 has a latch end 20*h* normally engaged with bell crank nose 20*k*. A stationary contact 28 connected to terminal 16 and a movable contact 26, mounted on movable contact arm 24 is electrically connected (not shown) to terminal 14 through bimetal 20*m*. The movable contact 26 is adapted to be moved into and out of engagement with contact 28 for closing and opening the circuit breaker motion transfer member 20*b* is movable with bimetallic member 20*m* for moving latch 20*f* as the bimetallic member moves and additional latch and spring means (not shown) are incorporated within bushing 18. It will be understood that, if the push-pull button 20 is manually depressing when the circuit breaker is open and when the bimetallic member 20*m* is cold, the bimetallic member, the motion transfer member 20*b* and the latch 20*f* are in the position shown in FIG. 1, the latch being biased by a spring part 20*n* to pivot to the right as viewed in the figure. Accordingly, the operating portion 20*a* moves the bell crank 20*c* downwardly to engage the nose 20*k* with the latch end 20*h* and to rotate the bell crank clockwise against the bias of spring 20*e* to engage movable contact 26 with stationary contact 28 to close the breaker circuit between terminals 14, 16. The releasable latch and spring means (not shown) within bushing 18 resiliently hold the bell crank in the position shown while the contacts are in the illustrated closed circuit condition. Pulling on button 20 with a selected force is effective to release the latch means within bushing 18 so that the bell crank rotates counterclockwise to disengage the movable contact 26 (see dashed line position) to open the circuit breaker and to move push button 20 outwardly to the FIG. 2 position. Further, an overload current will cause bimetallic member 20*m* to move toward the left as viewed in FIG. 1 with its motion transferred via motion transfer member 20*b* to cause the latch 20*f* to pivot to the left thereby separating nose 20*k* from latch end 20*h* allowing spring 20*e* to move contact 26 to the open position.

An annular normally white indicator portion 30 is provided on push button 20 so that the closed or open status of the circuit breaker can be readily discerned by visual inspection. Bushing 18, the top portion of push button 20, i.e., lip 21, and reduced diameter portion 34 are normally black thereby accentuating the visibility of indicator portion 30 when exposed with the button in the upper position. Generally there are a large number of circuit breakers mounted on suitable panels in a cockpit or the like in an aircraft and the ability to provide instant visual information on the status of the state of energization for such breakers is highly desirable.

Further details of one such circuit breaker can be obtained by reference to U.S. Pat. No. 4,400,677 noted above. Circuit breakers of this type are very effective and are in wide commercial use.

However, when splashed with fluid, such as sea water, some of the fluid can work its way into the interior of the circuit breaker housing 12 through a leakage path between push button 20 and bushing 18. Such fluid eventually can cause corrosion of the circuit breaker mechanism thereby adversely affecting its calibration and shortening its useful life.

As seen in FIGS. 3–6 in which circuit breaker 10' mounted on a conventional panel 11, has a fluid splash barrier 32 mounted on reduced diameter portion 34. Splash barrier 32 comprises a sleeve of suitable material such as silicone having corrosion resistance to fluids to which the circuit breaker is likely to be exposed and having a durometer of approximately 50 at room temperature and desired flexibility between −65° F. to 250° F. The length of barrier sleeve 32 is selected so that the lower distal portion 36 engages the top surface 38 of bushing 18 as push button 20 is depressed to its closed circuit position and is caused to bellow outwardly thereby placing a sealing force on top surface 38. The sealing force is selected to be approximately a half pound to a pound, sufficient to effectively seal the leakage path while well under the selected force of approximately 5 pounds required to manually open the circuit breaker and insufficient to interfere with the over-travel 42 of push button 20 (see FIG. 6) related to latching of the linkage mechanism. The inner diameter of the barrier sleeve is selected so that it can be received on reduced diameter portion 34 without placing any appreciable stretching force on the barrier sleeve when in the upper, FIG. 4 position. The outer diameter is chosen so that it is approximately equal to or slightly less than the lip portion 21 of push button 20 so that manual gripping of the push button will not be impeded. The combination of the hard lip portion 21 and the soft resilient sleeve provide a convenient gripping surface for manual opening of the circuit breaker.

Preferably, a bead of adhesive material, such as silicone, indicated by dashed lines 46, is placed centrally about the periphery of portion 34 prior to placing the sleeve on portion 34. Slipping sleeve 32 unto portion 34 effectively spreads the adhesive substantially along the surface area of portion 34 with the distal end portion 36 extending downwardly therefrom. If desired, reduced diameter portion 34, as seen at 44 in FIG. 5, may also be provided with a roughened surface, as by knurling to enhance the adhesion between barrier sleeve 32 and portion 34.

Selection of the inside diameter of the sleeve so that no appreciable stretching force is placed on the sleeve when placed on reduced diameter portion 34 avoids a tendency of having distal end 36 curl inwardly which could result in the generation of undesirable debris by nibbling due to engagement of the outer sleeve surface with the bushing surface as the circuit breaker is cycled, otherwise such debris could enter into the circuit breaker housing and possibly interfere with the circuit breaker function. By way of example, an inside diameter of 0.325/0.315 inches has been found to be suitable for a push button having a diameter of 0.334/0.326 inches for portion 34.

Although barrier sleeve 32 is separated from bushing 18 when in the open circuit position, there is no need to provide a seal in that position since normally the circuit breakers are maintained in the energized position.

It will be understood that various changes could be made in the above described embodiment without departing from the scope of the invention. For example, even though barrier sleeve 32 can be produced very inexpensively by extrusion, it is within the purview of the invention to provide molded barriers which, for example, instead of using adhesive, could have an inwardly extending flange receivable in a mating groove provided in portion 34 to maintain the barrier sleeve in the selected position along the longitudinal axis ensuring that it does not mask white indicator portion 30 when in the open circuit position. It is intended that all matter contained in the above description and the accompanying drawings shall be interpreted as illustrative and not in a limiting sense.

What is claimed is:

1. Circuit breaker apparatus comprising a housing having a top wall and a mounting bushing mounted on the top wall, the bushing having an annular top surface portion surrounding a bore, the bore extending into the housing, a generally cylindrical push button slidably disposed in the bore, an electrical switch mechanism disposed in the housing having a movable electrical contact movable into and out of engagement with a stationary electrical contact, the push button coupled to the movable electrical contact so that depression of the push button moves the movable electrical contact into engagement with the stationary electrical contact, the push button movable between an outward, circuit open position in which the electrical contacts are out of engagement, and an inward, circuit closed position in which the electrical contacts are in engagement with one another and a fluid splash barrier sleeve mounted on the push button, the fluid splash barrier sleeve being flexible and having a lower distal end portion which is out of engagement with the bushing when the push button is in the outward, circuit open position and is in engagement with the annular top surface portion of the bushing around the periphery thereof placing a selected amount of force on the bushing when the push button is in the inward, circuit closed position.

2. Circuit breaker apparatus according to claim 1 in which the push button has a cylindrical white indicator portion disposed between the bushing and the lower distal end portion of the fluid splash barrier sleeve when the push button is in the upper, open circuit position, the remainder of the push button, the fluid splash barrier sleeve and the bushing being of a contrasting color.

3. Circuit breaker apparatus according to claim 1 in which the selected force is in the range of approximately one half pound to one pound.

4. Circuit breaker apparatus according to claim 1 in which the barrier sleeve is composed of silicone having a hardness of approximately 50 durometer at room temperature.

5. Circuit apparatus according to claim 1 in which the push button has an upper distal end and has a lip extending radially outwardly at its upper distal end, a reduced diameter portion of the push button being disposed adjacent to the lip, the barrier sleeve received on the reduced diameter portion, the reduced diameter portion having a roughened surface and further including adhesive disposed on the roughened surface to secure the fluid splash barrier sleeve to the reduced diameter portion, the lower distal end portion of the fluid splash barrier sleeve extending beyond the reduced diameter portion along the longitudinal axis a selected distance toward the bushing when the push button is in the upper, open circuit position.

6. Circuit breaker apparatus according to claim 5 in which the roughened surface portion is knurled.

7. Circuit apparatus according to claim 1 in which the push button has an upper distal end and has a lip extending radially outwardly at its upper distal end, a reduced diameter portion of the push button being disposed adjacent to the lip, the barrier sleeve received on the reduced diameter portion, and further including adhesive disposed on the reduced diameter portion to secure the fluid splash barrier sleeve to the reduced diameter portion, the lower distal end portion of the fluid splash barrier sleeve extending beyond the reduced diameter portion along the longitudinal axis a selected distance toward the bushing when the push button is in the upper, open circuit position.

* * * * *